US008652735B2

(12) United States Patent
Sakata et al.

(10) Patent No.: US 8,652,735 B2
(45) **Date of Patent: *Feb. 18, 2014**

(54) CARRIER, DEVELOPER, METHOD OF MANUFACTURING CARRIER, DEVELOPER CONTAINER, IMAGE FORMING METHOD, PROCESS CARTRIDGE, IMAGE FORMING APPARATUS, AND SUPPLEMENTAL DEVELOPER

(75) Inventors: Koichi Sakata, Shizuoka (JP); Shigenori Yaguchi, Shizuoka (JP); Toyoshi Sawada, Kanagawa (JP); Kimitoshi Yamaguchi, Shizuoka (JP); Hitoshi Iwatsuki, Shizuoka (JP); Hiroshi Tohmatsu, Shizuoka (JP); Hiroyuki Kishida, Shizuoka (JP); Toyoaki Tano, Shizuoka (JP); Mariko Takii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

This patent is subject to a terminal disclaimer.

(21) Appl. No.: 13/213,633

(22) Filed: Aug. 19, 2011

(65) Prior Publication Data

US 2012/0057898 A1 Mar. 8, 2012

(30) Foreign Application Priority Data

Sep. 8, 2010 (JP) ..... 2010-200967
Aug. 1, 2011 (JP) ..... 2011-168170

(51) Int. Cl.
*G03G 9/00* (2006.01)

(52) U.S. Cl.
USPC ..... 430/111.35; 430/111.1; 430/111.3; 430/111.31

(58) Field of Classification Search
USPC ..... 430/111.1, 111.3, 111.31, 111.35, 430/123.4
See application file for complete search history.

(56) References Cited

U.S. PATENT DOCUMENTS

| | | | | |
|---|---|---|---|---|
| 7,381,513 | B2 | 6/2008 | Suzuki et al. | |
| 7,527,908 | B2 | 5/2009 | Iwatsuki et al. | |
| 7,553,598 | B2 | 6/2009 | Suzuki et al. | |
| 7,592,116 | B2 | 9/2009 | Suzuki et al. | |
| 8,211,610 | B2 * | 7/2012 | Yamaguchi et al. | 430/111.35 |
| 2006/0210905 | A1 | 9/2006 | Imahashi et al. | |

(Continued)

FOREIGN PATENT DOCUMENTS

| | | |
|---|---|---|
| JP | 42-1627 | 1/1967 |
| JP | 41-20153 | 11/1967 |

(Continued)

OTHER PUBLICATIONS

U.S. Appl. No. 113/181,702, filed Jul. 13, 2011, Yamaguchi, et al.

(Continued)

*Primary Examiner* — Stewart Fraser
(74) *Attorney, Agent, or Firm* — Oblon, Spivak, McClelland, Maier & Neustadt, L.L.P.

(57) ABSTRACT

A carrier including a magnetic core particle and a resin layer covering a surface of the magnetic core particle. The magnetic core particle is a ferrite particle including strontium in an amount of 0.005 to 3% by mass, measured by fluorescent X-ray spectroscopy. The resin layer comprises a resin obtained by heating a copolymer comprising a silicon-containing unit A and another silicon-containing specific unit B.

14 Claims, 3 Drawing Sheets

(56) References Cited

U.S. PATENT DOCUMENTS

| | | | | |
|---|---|---|---|---|
| 2007/0048652 | A1 | 3/2007 | Imahashi et al. | |
| 2008/0096121 | A1 | 4/2008 | Iwatsuki et al. | |
| 2008/0152393 | A1 | 6/2008 | Nagayama et al. | |
| 2008/0213684 | A1 | 9/2008 | Nagayama et al. | |
| 2008/0227004 | A1 | 9/2008 | Yamaguchi et al. | |
| 2009/0092920 | A1 | 4/2009 | Nagayama et al. | |
| 2010/0233613 | A1 | 9/2010 | Masuda et al. | |
| 2010/0239975 | A1* | 9/2010 | Yamaguchi et al. | 430/111.35 |
| 2011/0065037 | A1 | 3/2011 | Iwatsuki et al. | |
| 2011/0086307 | A1* | 4/2011 | Nakajima et al. | 430/111.3 |
| 2011/0091802 | A1* | 4/2011 | Takahashi et al. | 430/108.3 |
| 2011/0171573 | A1 | 7/2011 | Sakata et al. | |
| 2011/0217649 | A1 | 9/2011 | Masuda et al. | |
| 2011/0229817 | A1* | 9/2011 | Yamada et al. | 430/111.35 |
| 2012/0058423 | A1* | 3/2012 | Yamaguchi et al. | 430/105 |

FOREIGN PATENT DOCUMENTS

| | | |
|---|---|---|
| JP | 43-27596 | 11/1968 |
| JP | 44-6397 | 3/1969 |
| JP | 45-26478 | 9/1970 |
| JP | 55-127569 | 10/1980 |
| JP | 55-42752 | 11/1980 |
| JP | 55-157751 | 12/1980 |
| JP | 56-140358 | 11/1981 |
| JP | 57-96355 | 6/1982 |
| JP | 57-96356 | 6/1982 |
| JP | 58-207054 | 12/1983 |
| JP | 59-7385 | 2/1984 |
| JP | 7-21654 | 3/1995 |
| JP | 7-120085 | 12/1995 |
| JP | 2801492 | 7/1998 |
| JP | 11-217389 | 8/1999 |
| JP | 3243376 | 10/2001 |
| JP | 3691115 | 6/2005 |
| JP | 2006-337828 | 12/2006 |
| JP | 4091538 | 3/2008 |
| JP | 4197172 | 10/2008 |
| JP | 4201932 | 10/2008 |

OTHER PUBLICATIONS

U.S. Appl. No. 13/226,219, filed Sep. 6, 2011, Kishida, et al.
U.S. Appl. No 13/037,569, filed Mar. 1, 2011, Saori Yamada, et al.

* cited by examiner

CARRIER, DEVELOPER, METHOD OF MANUFACTURING CARRIER, DEVELOPER CONTAINER, IMAGE FORMING METHOD, PROCESS CARTRIDGE, IMAGE FORMING APPARATUS, AND SUPPLEMENTAL DEVELOPER

CROSS-REFERENCE TO RELATED APPLICATIONS

The present patent application claims priority pursuant to 35 U.S.C. §119 from Japanese Patent Application Nos. 2010-200967 and 2011-168170, filed on Sep. 8, 2010 and Aug. 1, 2011, respectively, each of which is hereby incorporated by reference herein in its entirety.

BACKGROUND

1. Field of the Invention

The present invention relates to a carrier for developing electrostatic latent image, a developer including the carrier, a method of manufacturing the carrier, a developer container including the developer, an image forming method using the developer, a process cartridge including the developer, an image forming apparatus including the developer, and a supplemental developer including the carrier.

2. Description of the Background

In electrophotographic image formation, an electrostatic latent image is formed on an image bearing member comprising a photoconductive material, and the electrostatic latent image is developed into a toner image with a charged toner. The toner image is then transferred onto and fixed on a recording medium. In the field of electrophotography, full-color copiers and printers have been brought to the mainstream in place of monochrome copiers and printers recently.

In a typical full-color image formation, toner layers of yellow, magenta, cyan, and optional black are superimposed on one another to reproduce various colors, and the resulting composite toner image is finally fixed on a recording medium. To obtain a vivid full-color image in which colors are precisely reproduced, the surface of the composite toner image fixed on the recording medium is preferably as smooth as possible so as to reduce light scattering. Thus, a typical full-color image has a middle to high image gloss level of 10 to 50%.

Typically, a toner image is fixed on a recording medium by pressing a heated roller or belt against the toner image on the recording medium. Such a fixing method may be called as contact heating fixing method. The contact heating fixing method provides high thermal efficiency and high-speed fixing, thus providing images with high gloss and transparency. However, because the heated roller or belt is pressed against the melted toner image and then separated therefrom, the method causes an undesirable phenomenon in which a part of the toner image is adhered to a surface of the roller or belt and retransferred onto another image. This phenomenon is hereinafter called as hot offset.

To prevent the occurrence of hot offset, there has been a proposal to form the surface of the roller or belt with a material having high separability (repellency) such as a silicone rubber or a fluorine-containing resin and further apply an offset preventing oil such as a silicone oil to the surface, which has been widely employed. The offset preventing oil effectively prevents the occurrence of hot offset but requires an apparatus that applies the oil to the roller or belt. Therefore, the fixing device undesirably becomes larger and larger.

In view of this, toners for forming monochrome images have been developed to include a release agent and to express a large viscoelasticity when melted. Such toners can be used for fixing systems in which no oil or a slight amount of oil is applied to the fixing roller or belt (hereinafter "oilless fixing systems").

Recently, compact and simple oilless fixing systems are spreading in the field of full-color image formation technology as well as in the field of monochrome image formation technology. However, it is likely that hot offset more frequently occurs in full-color image formation because toners are designed to express a lower viscoelasticity when melted so that the fixed toner image has a smooth surface. Therefore, it is difficult to employ oilless fixing systems in full-color image formation. Disadvantageously, toner particles including a release agent are transferred onto a recording medium at a lower transfer rate due to their high adhesive property. Further, such toner particles may make thin films thereof on carrier particles (hereinafter "filming"), resulting in deterioration of chargeability and durability.

On the other hand, there have been various attempts to provide a low-surface-energy covering layer, comprised of a fluorine-based resin, a silicone resin, or the like, on a core material of carrier, for the purpose of preventing the occurrence of filming, forming a uniform carrier surface, preventing oxidation of the carrier surface, preventing deterioration of humidity resistance, extending the lifespan of two-component developer, preventing adherence of carrier to photoreceptor, protecting photoreceptor from scratch or abrasion, and controlling charge polarity and quantity.

On the other hand, disadvantageously, recent toners are more adhesive to carrier particles because they have a small particle diameter and are subjected to a high-speed printing. Such toners further including a release agent are much more adhesive to carrier particles. In this case, toner charge is so reduced that toner scattering and background fouling easily occur.

When toner particles adhere to carrier particles or covering layers of the carrier particles are abraded or peeled off, electric resistance and toner supplying power of the carrier particles are changed. As a result, the resulting image density is changed, especially in high light portions, and the resulting image is contaminated with fillers released from the covering layer, especially in yellow images.

Further, there is a possibility that the covering layer causes blocking or deteriorates durability.

SUMMARY

Exemplary aspects of the present invention are put forward in view of the above-described circumstances, and provide a novel carrier for developing electrostatic latent image that is resistant to toner adherence and abrasion.

In one exemplary embodiment, a novel carrier comprises a magnetic core particle and a resin layer covering a surface of the magnetic core particle. The magnetic core particle is a ferrite particle including strontium in an amount of 0.005 to 3% by mass, measured by fluorescent X-ray spectroscopy. The resin layer comprises a resin obtained by heating a copolymer comprising a unit A having the following formula (A) and a unit B having the following formula (B):

(A)

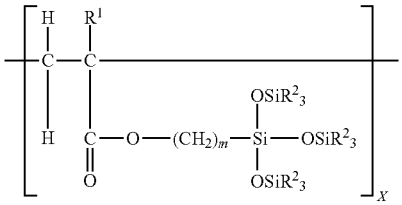

(B)

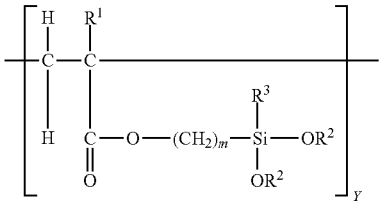

wherein $R^1$ represents a hydrogen atom or a methyl group, each of multiple $R^2$ independently represents an alkyl group having 1 to 4 carbon atoms, $R^3$ represents an alkyl group having 1 to 8 carbon atoms or an alkoxy group having 1 to 4 carbon atoms, m represents an integer of 1 to 8, X represents a molar ratio (%) between 10 to 90, and Y represents a molar ratio (%) between 90 to 10.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
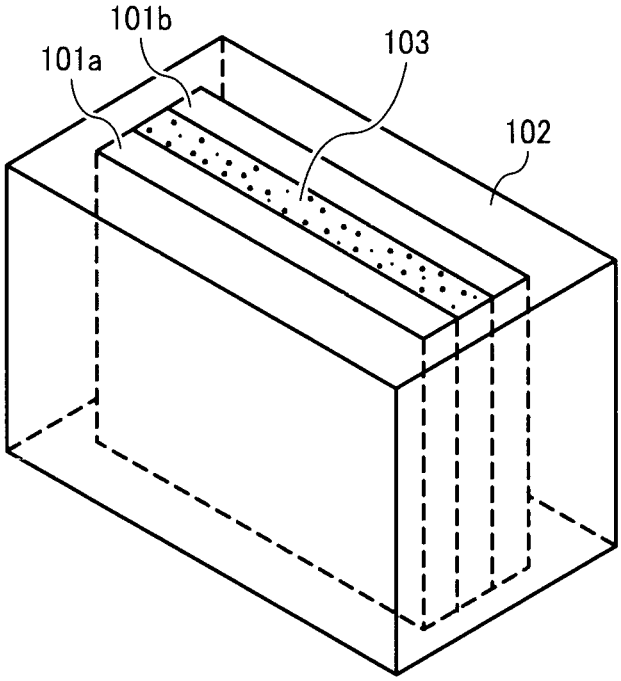
FIG. 1 is a schematic view illustrating a measuring cell for measuring volume resistivity of carriers.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Exemplary aspects of the present invention provides a carrier for developing electrostatic latent image, comprising a magnetic core particle and a resin layer that covers a surface of the magnetic core particle. The core particle is a ferrite particle including strontium in an amount of 0.005 to 3% by mass measured by fluorescent X-ray spectroscopy. The resin layer includes a resin obtained by heating a copolymer comprising a unit A having the following formula (A) and a unit B having the following formula (B).

(A)

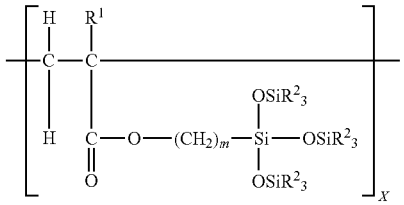

In the formula (A), $R^1$ represents a hydrogen atom or a methyl group; each of multiple $R^2$ independently represents an alkyl group having 1 to 4 carbon atoms, such as methyl group, ethyl group, propyl group, isopropyl group, and butyl group; and m represents an integer of 1 to 8. Thus, the alkylene group represented by $(CH)_m$ may be methylene group, ethylene group, propylene group, or butylene group, for example.

The molar ratio X (%) of the unit A is 10 to 90%, preferably 10 to 40%, and more preferably 20 to 30%. The unit A has a tris(trialkylsiloxy)silane that is an atom group having multiple alkyl groups on side chains. As the ratio of the unit A increases in the resin, the surface energy of the resulting carrier becomes lower. A carrier having such a low surface energy is less adhesive to binder resin and/or wax of toner. When the molar ratio of the unit A is too small, binder resin and/or wax of toner may considerably adhere to the resulting carrier. When the molar ratio of the unit A is too large, the molar ratio of the unit B is too small, and therefore the resin layer may have poor toughness and the adherence between the core particle and the resin layer may be too weak, degrading durability of the resulting carrier.

Specific examples of monomers that form the unit A include, but are not limited to, tris(trialkylsiloxy)silane compounds represented by the following formulae $CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ In the above formulae, Me, Et, and Pr respectively represents methyl group, ethyl group, and propyl group.

The monomer that forms the unit A may be obtained by, for example, reacting a tris(trialkylsiloxy)silane with aryl acrylate or aryl methacrylate in the presence of a platinum catalyst, or reacting methacryloxyalkyl trialkoxysilane with hexaalkyl disiloxane in the presence of a carboxylic acid and an acid catalyst as described in Japanese Patent Application Publication No. 11-217389, the disclosure thereof being incorporated herein by reference. Two or more of these compounds can be used in combination.

The unit B is a cross-linking component and is represented by the following formula (B).

(B)

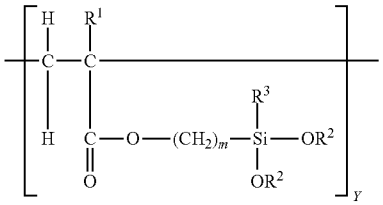

In the formula (B), $R^1$, $R^2$, and m are the same as those in the formula (A) described above. $R^3$ represents an alkyl group having 1 to 8 carbon atoms such as methyl group, ethyl group, propyl group, isopropyl group, and butyl group, or an alkoxy group having 1 to 4 carbon atoms such as methoxy group, ethoxy group, propoxy group, and butoxy group.

The molar ratio Y (%) of the unit B is 10 to 90%, preferably 10 to 80%, and more preferably 15 to 70%. When the molar ratio of the unit B is too small, the resin layer may have poor toughness. When the molar ratio of the unit B is too large, the resin layer may be so stiff and brittle that abrasion may be caused. Additionally, environmental stability (humidity dependence) may be poor because a large number of silanol groups generated from hydrolyzed cross-linked components may remain.

The monomer that forms the unit B (including a precursor thereof) may be, for example, a radical-polymerizable difunctional silane compound (when $R^3$ is an alkyl group) or a radical-polymerizable trifunctional silane compound (when $R^3$ is an alkoxy group).

Specific examples of the monomer that forms the unit B include, but are not limited to, 3-methacryloxypropyl trimethoxysilane, 3-acryloxypropyl trimethoxysilane, 3-methacryloxypropyl triethoxysilane, 3-acryloxypropyl triethoxysilane, 3-methacryloxypropyl methyldimethoxysilane, 3-methacryloxypropyl methyldiethoxysilane, 3-methacryloxypropyl tri(isopropoxy)silane, and 3-acryloxypropyl tri(isopropoxy)silane. Two or more of these compounds can be used in combination.

In attempting to improve durability of carrier, there has been a proposal to form a cross-linked resin layer on a core particle. For example, Japanese Patent No. 3691115 describes a carrier having a covering layer including a thermosetting resin obtained by cross-linking a copolymer of an organopolysiloxane having a terminal vinyl group and a radical-polymerizable monomer having at least one of hydroxyl group, amino group, amide group, and imide group, with an isocyanate compound. However, this carrier is not resistant to peeling off or abrasion of the resin layer.

This is because the number of functional groups (i.e., active-hydrogen-containing groups such as amino group, hydroxyl group, carboxyl group, mercapto group) per unit weight of the copolymer to be cross-linked with the isocyanate compound is too small to form two-dimensional or three-dimensional dense cross-linking structure. Such a resin layer may peel off from the core particle or may be abraded after a long term of use.

Peeing off or abrasion of the resin layer reduces resistance of the carrier, resulting in poor-quality image with carrier deposition. Peeing off or abrasion of the resin layer also reduces fluidity of developer, resulting in poor-quality image with low image density, background fouling, and/or toner scattering.

The copolymer according to exemplary embodiments includes about 2 to 3 times the number of difunctional or trifunctional cross-linkable functional groups per unit weight than the above resin, and is further subjected to cross-linking by condensation polymerization. Thus, the resulting resin layer is tough and not abraded.

Additionally, siloxane cross-linking bonds have greater binding energy and are more resistant to thermal stress than isocyanate cross-linking bonds, providing better temporal stability.

To improve flexibility and adhesiveness between the core particle and the resin layer and between the resin layer and the conductive particle, the copolymer may further include a unit C having the following formula (C). In other words, the resin layer may include a copolymer having the following formula (1).

(C)

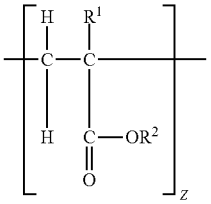

(1)

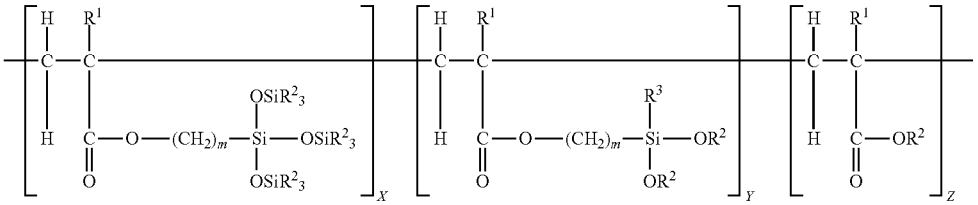

In the formulae (C) and (1), $R^1$ represents a hydrogen atom or a methyl group; each of multiple $R^2$ independently represents an alkyl group having 1 to 4 carbon atoms, such as methyl group, ethyl group, propyl group, isopropyl group, and butyl group; $R^3$ represents an alkyl group having 1 to 8 carbon atoms such as methyl group, ethyl group, propyl group, isopropyl group, and butyl group, or an alkoxy group having 1 to 4 carbon atoms such as methoxy group, ethoxy group, propoxy group, and butoxy group; and m represents an integer of 1 to 8. Thus, the alkylene group represented by $(CH)_m$ may be methylene group, ethylene group, propylene group, or butylene group, for example.

In the formula (1), the molar ratio X (%) of the unit A is 10 to 40%, and the molar ratio Y (%) of the unit B is 10 to 40%. The molar ratio Z (%) of the unit C is 30 to 80%, and preferably 35 to 75%. Additionally, $60<Y+Z<90$ is satisfied, and preferably $70<Y+Z<85$ is satisfied. When the molar ratio Z (%) of the unit C is too large, the molar ratio Y (%) of the unit A or the molar ratio Y (%) of the unit B becomes too small. As a result, the resulting resin layer cannot achieve a good balance between repellency, stiffness, and flexibility.

Monomers that form the unit C may be, for example, radical-polymerizable acrylic or methacrylic compounds having acryloyl or methacryloyl group.

Specific examples of such acrylic and methacrylic compounds include, but are not limited to, acrylates and methacrylates such as methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino) ethyl methacrylate, and 2-(diethylamino)ethyl acrylate.

Among these compounds, alkyl methacrylates are preferable and methyl acrylate is most preferable. Two or more of these compounds can be used in combination.

The above-described copolymer according to exemplary embodiments is an acrylic or methacrylic copolymer obtained by radical-polymerizing the monomers that form the units A, B, and optional C. This copolymer has a large number of cross-linkable functional groups per unit weight of the copolymer, and is further subjected to condensation polymerization by heating. Thus, the resulting resin layer is tough and not abraded.

Additionally, siloxane cross-linking bonds have greater binding energy and are more resistant to thermal stress than isocyanate cross-linking bonds, providing better temporal stability.

The resin layer preferably includes a silicone resin having a silanol group and/or a functional group that generates a silanol group by hydrolysis (e.g., a negative group such as a halogeno group binding to an alkoxy group and Si atom). Such a silicone resin can be directly condensation-polymerized with the unit B.

The copolymer having the silicone resin component is less adhesive to toner.

The silicone resin having a silanol group and/or a functional group that generates a silanol group by hydrolysis preferably has at least one of the repeating units having the following formula (2):

(2)

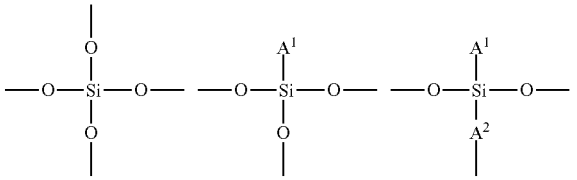

wherein $A^1$ represents a hydrogen atom, a halogen atom, a hydroxyl group, a methoxy group, or an alkyl or aryl group having 1 to 4 carbon atoms, and $A^2$ represents an alkylene or arylene group having 1 to 4 carbon atoms.

The halogen atom may be, for example, fluorine, chlorine, bromine, or iodine. The alkyl group having 1 to 4 carbon atoms may be, for example, methyl group, ethyl group, propyl group, isopropyl group, or butyl group. The aryl group may be, for example, phenyl group or tolyl group. The alkylene group having 1 to 4 carbon atoms may be, for example, methylene group, ethylene group, propylene group, and butylene group. The arylene group may be, for example, phenylene group or naphthylene group.

The aryl group preferably has 6 to 20 carbon atoms, more preferably 6 to 14 carbon atoms. The aryl group may be, for example, an aryl group derived from benzene (i.e., phenyl group); an aryl group derived from a condensed polycyclic aromatic hydrocarbon such as naphthalene, phenanthrene, and anthracene; or an aryl group derived from a chained polycyclic aromatic hydrocarbon such as biphenyl and terphenyl. The aryl group may have a substituent.

The arylene group preferably has 6 to 20 carbon atoms, more preferably 6 to 14 carbon atoms. The arylene group may be, for example, an arylene group derived from benzene (i.e., phenylene group); an arylene group derived from a condensed polycyclic aromatic hydrocarbon such as naphthalene, phenanthrene, and anthracene; or an arylene group derived from a chained polycyclic aromatic hydrocarbon such as biphenyl and terphenyl. The arylene group may have a substituent.

Specific examples of usable commercially available silicone resins include, but are not limited to, KR251, KR271, KR272, KR282, KR252, KR255, KR152, KR155, KR211, KR216, and KR213 (from Shin-Etsu Chemical Co., Ltd.); and AY42-170, SR2510, SR2400, SR2406, SR2410, SR2405, and SR2411 (from Dow Corning Toray Co., Ltd.).

Among various silicone resins, methyl silicone resins are preferable because they are less adhesive to toner and their charge is less susceptible to environmental fluctuation.

The silicone resin preferably has a weight average molecular weight of 1,000 to 100,000, more preferably 1,000 to 30,000. When the weight average molecular weight is too large, the resulting resin layer may be not uniform because the coating liquid has too large a viscosity. Moreover, the hardened resin layer may have a low density. When the weight average molecular weight is too small, the hardened resin layer may be too brittle.

The content of the silicone resin is preferably 5 to 80 parts by weight, more preferably 10 to 60 parts by weight, based on 100 parts by weight of the copolymer. When the content of the silicone resin is too small, the resulting resin layer may be adhesive to toner. When the content of the silicone resin is too large, the resulting resin layer may have poor toughness and may be easily abraded.

The resin layer may further include a silane coupling agent to improve dispersibility of conductive particles and to control charge of toner.

Specifically, to control charge of toner, a proper amount of the following aminosilane coupling agent (in an amount of 0.001 to 30 parts by weight, preferably 0.1 to 20 parts by weight, based on 100 parts of the silicone resin) is preferably included along with the silicone resin.

| | |
|---|---|
| $H_2N(CH_2)_3Si(OCH_3)_3$ | Mw = 179.3 |
| $H_2N(CH_2)_3Si(OCH_2H_5)_3$ | Mw = 221.4 |
| $H_2NCH_2CH_2CH_2Si(CH_3)_2(OC_2H_5)$ | Mw = 161.3 |
| $H_2NCH_2CH_2CH_2Si(CH_3)(OC_2H_5)_2$ | Mw = 191.3 |
| $H_2NCH_2CH_2NHCH_2Si(OCH_3)_3$ | Mw = 194.3 |
| $H_2NCH_2CH_2NHCH_2CH_2CH_2Si(CH_3)(OCH_3)_2$ | Mw = 206.4 |
| $H_2NCH_2CH_2NHCH_2CH_2CH_2Si(OCH_3)_3$ | Mw = 224.4 |
| $(CH_3)_2NCH_2CH_2CH_2Si(CH_3)(OC_2H_5)_2$ | Mw = 219.4 |
| $(C_4H_9)_2NC_3H_6Si(OCH_3)_3$ | Mw = 291.6 |

The resin layer may further include another resin in addition to a silicone resin having a silanol group and/or a functional group that generates a silanol group. Specific examples of usable resins include, but are not limited to, acrylic resins, amino resins, polyvinyl resins, polystyrene resins, halogenated olefin resins, polyester resins, polycarbonate resins, polyethylene resins, polyvinyl fluoride resins, polyvinylidene fluoride resins, poly(trifluoroethylene) resins, poly(hexafluoropropylene) resins, copolymer of vinylidene fluoride and vinyl fluoride, fluoroterpolymer (e.g., terpolymer of tetrafluoroethylene, vinylidene fluoride, and a non-fluoride monomer), and silicone resins having no silanol group and/or no hydrolyzable group. Two or more of these resins can be used in combination. Among these resins, acrylic resins are preferable because they are adhesive to the core particle and conductive particle while being less brittle.

The acrylic resin preferably has a glass transition temperature of 20 to 100° C., more preferably 25 to 80° C. Such an acrylic resin has proper elasticity. When the carrier frictionally charges toner, the resin layer receives strong impact due to friction between toner particle and carrier particle, or between carrier particles. The acrylic resin having proper elasticity absorbs the impact and thus prevents deterioration of the resin layer.

Further, the resin layer preferably includes a cross-linked material between an acrylic resin and an amino resin.

Such a resin layer has proper elasticity and prevents fusion between resin layers.

Specific examples of usable amino resins include, but are not limited to, melamine resins and benzoguanamine resins, which can improve charge giving ability of the resulting carrier. To more properly control the charge giving ability of the resulting carrier, a melamine resin and/or a benzoguanamine resin are/is preferably used in combination with another amino resin.

Acrylic resins which form cross-links between the amino resins preferably include a hydroxyl group and/or a carboxyl group, more preferably a hydroxyl group. In this case, both adhesiveness between the resin layer and the core particle or conductive particle, and dispersion stability of the conductive particle are improved. The acrylic resin preferably has a hydroxyl value of 10 mgKOH/g or more, and more preferably 20 mgKOH/g or more.

To accelerate condensation reaction of the unit B, titanium-based catalysts, tin-based catalysts, zirconium-based catalysts, or aluminum-based catalysts can be used. Among these catalysts, titanium-based catalysts are preferable. More specifically, titanium alkoxide catalysts and titanium chelate catalysts are preferable.

The above catalysts effectively accelerate condensation reaction of silanol group derived from the unit B, while keeping good catalytic ability. Specific examples of the titanium alkoxide catalysts include, but are not limited to, titanium diisopropoxy bis(ethylacetoacetate) having the following formula (3). Specific examples of the titanium chelate catalysts include, but are not limited to, titanium diisopropoxy bis(triethanolaminate) having the following formula (4).

$$Ti(O\text{-}i\text{-}C_3H_7)_2(C_6H_9O_3)_2 \quad (3)$$

$$Ti(O\text{-}i\text{-}C_3H_7)_2(C_6H_{14}N)_2 \quad (4)$$

Thus, the resin layer can be formed from a resin layer composition including a solvent, the copolymer having the units A and B, the titanium diisopropoxy bis(ethylacetoacetate) catalyst, and optional resins, for example.

The resin layer may be formed by subjecting silanol groups to condensation reaction by applying heat or light, while the core particle is covered with the resin layer composition. Alternatively, the resin layer may be formed by subjecting silanol groups to condensation reaction by applying heat, after the core particles has been covered with the resin layer composition.

Generally, high-molecular-weight resins have high viscosity, and therefore it is difficult to uniformly apply such resins to small-diameter particles without causing aggregation.

Therefore, the copolymer preferably has a weight average molecular weight of 5,000 to 100,000, more preferably 10,000 to 70,000, and most preferably 30,000 to 40,000. When the weight average molecular weight is too small, the resin layer may have poor strength. When the weight average molecular weight is too large, viscosity of the coating liquid may be so large that manufacturability decreases.

The resin layer preferably includes a conductive particle to control volume resistivity of the carrier. Specific preferred examples of suitable conductive particle include, but are not limited to, carbon black, indium tin oxide (ITO), tin oxide, and zinc oxide. Two or more of these materials can be used in combination.

The content of the conductive particle is preferably 0.1 to 1,000 parts by weight based on 100 parts by weight of the silicone resin. When the amount of the conductive particle is too small, the resistance of the carrier cannot be well controlled. When the amount of the conductive particle is too large, the conductive particle may easily release from the carrier.

The conductive particle preferably covers 10 to 80%, more preferably 40 to 80%, of the surface of the core particle. When the coverage is too small, it means that the amount of the conductive particle is too small to keep a proper conductivity. When the coverage is too large, it is difficult for the resin layer to retain the conductive particle, resulting in deterioration of the resin layer.

The coverage is calculated from the following formula:

$$\text{Coverage}(\%)=(Wd/Wc)\times(\rho c/\rho d)\times(Dc/Dd)\times(1/4)\times 100$$

wherein Wd represents a weight (g) of the conductive particle, Wc represents a weight (g) of the core particle, ρc represents a true density (g/cm$^3$) of the core particle, ρd represents a true density (g/cm$^3$) of the conductive particle, Dc represents a weight average particle diameter (μm) of the core particle, and Dd represents a weight average particle diameter (μm) of the conductive particle.

The core particle covered with the resin composition is heated at a temperature less than the Curie point of the core particle, preferably at 100 to 350° C., more preferably at 150 to 250° C., so that cross-linking reaction (i.e., condensation reaction) is accelerated.

When the heating temperature is too low, the cross-linking reaction may not proceed and the resulting layer may have poor strength. When the heating temperature is too high, the copolymer may become carbonized and the resulting layer may be easily abraded.

The resin layer preferably has an average thickness of 0.05 to 4 μm. When the average thickness is too small, the resin layer may be easily destroyed or abraded. When the average thickness is too large, the carrier may easily adhere to images because the resin layer has no magnetic property.

The core particle is a ferrite particle including strontium in an amount of 0.005 to 3% by mass measured by fluorescent X-ray spectroscopy.

When each particle of the ferrite includes no strontium, magnetization varies among the particles and a large amount of particles having a low magnetization exists. Thus, it is likely that the carrier particles scatter and adhere to the resulting image. When the content of strontium is too small, the carrier particles may significantly scatter especially when the number of printed images is increased. When the content of strontium is too large, the carrier particles may have too large a magnetization. As a result, the carrier particles may be formed into stiff or rigid magnetic brush, which may produce abnormal image.

The content of strontium is measured by fluorescent X-ray spectroscopy as follows. An analyte (e.g., core particle, carrier) is subjected to a measurement by a fluorescent X-ray spectrometer ZSX100e (from Rigaku Corporation) to determine contents of each elements using its scanning function called EZ SCAN. The analyte is uniformly adhered to a polyester film to which an adhesive is applied to prepare a specimen, and the specimen is set to a specimen table. Measurement conditions are set as follows.

Measurement range: B-U
Measurement diameter: 30 mm
Sample geometry: Metal
Measurement time: Long
Atmosphere: Vacuum The core particle can be prepared as follows, for example. First, raw materials of a ferrite, e.g., MnO, MgO, $Fe_2O_3$, $SrCO_3$, are adequately weighed, and dispersed in an adequate amount of water using a disperser (e.g., ball mill, vibration mill) for 0.5 to 24 hours, thus preparing a slurry. The slurry is then subjected to drying, pulverization, and pre-burning at 500 to 1,500° C. The pre-burnt product is pulverized into particles having a desired particle diameter using a ball mill. The particles are mixed with water, a binder resin, and other additives, and subjected to granulation by spray drying. The granulated product is burnt at 800 to 1,600° C. in a furnace, and then subjected to pulverization and classification to obtain particles having a desired particle diameter distribution. The surface of the particles may be subjected to oxidization again, if needed.

The core particle preferably has a weight average particle diameter (Dw) of 20 to 65 μm. When the weight average particle diameter is too small, carrier deposition may occur. When the weight average particle diameter is too large, the resulting image may not precisely reproduce thin lines.

The weight average particle diameter of the core particle can be measured by a Microtrac particle size analyzer HRA9320-X100 (from Nikkiso Co., Ltd.).

The weight average particle diameter (Dw) is calculated based on a particle diameter distribution (i.e., a relation between number frequency and particle diameter) of particles as follows:

$$Dw=\{1/\Sigma(nD^3)\}\times\{\Sigma(nD^4)\}$$

wherein D represents a representative particle diameter (μm) of particles present in each channel and n represents the number of the particles present in each channel.

The channel represents a unit length that divides the measuring range of particle diameter into a measuring unit width. In this specification, the channel has a length of 2 μm.

The minimum particle diameter present in each channel is employed as the representative particle diameter.

The carrier preferably has a magnetization of 40 to 90 $Am^2/kg$ in a magnetic field of 1 kOe ($10^6/4\pi$[A/m]). When the magnetization is too small, carrier deposition may occur. When the magnetization is too large, the magnetic brush may be so stiff that the resulting image has blurring.

The magnetization can be measured by an instrument High Sensitivity Vibrating Sample Magnetometer VSM-P7-15 (from Toei Industry Co., Ltd.).

The carrier preferably has a volume resistivity of $1\times10^9$ Ω·cm to $1\times10^{17}$ Ω·cm. When the volume resistivity is too small, carrier deposition may occur in non-image portions. When the volume resistivity is too large, an unacceptable degree of the edge effect may occur.

The volume resistivity can be measured using a measuring cell illustrated in FIG. 1 as follows. The measuring cell is comprised of a fluorocarbon-resin container 102, in which electrodes 101*a* and 101*b* each having a surface area of 2.5 cm×4 cm are facing at a distance of 0.2 cm. The measuring cell is filled with the carrier 103 and tapped from a height of 1 cm for 10 times at a tapping speed of 30 times/min. Thereafter, a direct current voltage of 1,000 V is applied to between the electrodes 101*a* and 101*b* for 30 seconds to measure a resistance r (Ω) by a high resistance meter 4329A (from Hewlett-Packard Japan. Ltd.). A volume resistivity (Ω·cm) is calculated from the following equation:

$$\text{Volume Resistivity}(\Omega\cdot\text{cm})=r\times(2.5\times4)/0.2$$

The developer according to the present invention includes the above-described carrier according to the present invention and a toner.

The toner includes a binder resin and a colorant. The toner may be either a monochrome toner for producing monochrome images or a full-color toner for producing full-color images. The toner may further include a release agent so as to be usable in oilless fixing systems in which no oil is applied to a fixing member. Although such a toner including a release agent easily causes filming, the carrier according to the present invention can prevent the occurrence of filming. Therefore, the developer according to the present invention can provide high-quality images for an extended period of time. Because the carrier according to the present invention prevents peeling off of the resin layer, even yellow images may not be contaminated.

The toner can be manufactured by known methods such as pulverization methods and polymerization methods. In a typical pulverization method, raw materials are melt-kneaded and cooled, the melt-kneaded mixture is pulverized into particles, and the particles are classified by size to prepare mother particles. Further, an external additive is externally added to the mother particles to improve transferability and durability.

Specific examples of usable kneaders include, but are not limited to, a batch-type double roll mill; Banbury mixer; double-axis continuous extruders such as TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KEX EXTRUDER (from Kurimoto, Ltd.); and single-axis continuous extruders such as KONEADER (from Buss Corporation).

The cooled melt-kneaded mixture is pulverized into coarse particles by a hammer mill or a roatplex, and the coarse particles are pulverized into fine particles by a jet-type pulverizer or a mechanical pulverizer. Preferably, the pulverization condition is set so that toner particles having an average particle diameter of 3 to 15 μm are obtained.

The pulverized particles may be classified by a wind-power classifier. Preferably, the classification condition is set so that mother particles having an average particle diameter of 5 to 20 μm are collected.

The external additive and the mother particles are mixed and agitated by a mixer so that the external additive is adhered to the surfaces of the mother particles while being pulverized by the agitation.

Specific examples of usable binder resins, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-acrylonitrile-indene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Additionally, the following binder resins for pressure fixing can also be used: polyolefin resins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-malic acid anhydride copolymer, maleic-acid-modified phenol resin, and phenol-modified terpene resin. Two or more of these resins can be used in combination.

Specific examples of usable colorants (e.g., pigments, dyes) include, but are not limited to, yellow colorants such as Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange colorants such as Molybdenum Orange, Permanent Orange GTR, Pyrazolone Orange, Vulcan Orange, Indanthrene Brilliant Orange RK, Benzidine Orange G, and Indanthrene Brilliant Orange GK; red colorants such as Colcothar, Cadmium Red, Permanent Red 4R, Lithol Red, Pyrazolone Red, Watching Red Calcium Salt, Lake Red D, Brilliant Carmine 6B, Eosin Lake, Rhodamine Lake B, Alizarine Lake, and Brilliant Carmine 3B; violet colorants such as Fast Violet B and Methyl Violet Lake; blue colorants such as Cobalt Blue, Alkali Blue, Victoria Blue Lake, Phthalocyanine Blue, Metal-free Phthalocyanine Blue, Phthalocyanine Blue Partial Chloride, Fast Sky Blue, and Indanthrene Blue BC; green colorants such as Chrome Green, Chrome Oxide, Pigment Green B, and Malachite Green Lake; and black pigments such as azine dyes (e.g., Carbon Black, Oil Furnace Black, Channel Black, Lamp Black, Acetylene Black, Aniline Black), metal salt azo dyes, metal oxides, and complex metal oxides. Two or more of these colorants can be used in combination.

Specific examples of usable release agents include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further include a charge controlling agent. Specific examples of usable charge controlling agents include, but are not limited to, nigrosine dyes, azine dyes having an alkyl group having 2 to 16 carbon atoms described in Examined Japanese Application Publication No. 42-1627, the disclosures thereof being incorporated herein by reference; basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), C. I. Basic Green 4 (C. I. 42000)) and lake pigments thereof; quaternary ammonium salts (e.g., C. I. Solvent Black 8 (C. I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478, the disclosures thereof being incorporated herein by reference; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385, the disclosures thereof being incorporated herein by reference; sulfonated copper phthalocyanine pigments; organic boron salts; fluorine-containing quaternary ammonium salts; and calixarene compounds. Two or more of these materials can be used in combination. Preferably, the toners having colors other than black include a white metal salt of a salicylic acid derivative.

Specific examples of usable external additives include, but are not limited to, inorganic particles of silica, titanium oxide, alumina, silicon carbide, silicon nitride, and boron nitride; and resin particles of polymethyl methacrylate and polystyrene having an average particle diameter of 0.05 to 1 μm, which are obtained by soap-free emulsion polymerization. Two or more of these materials can be used in combination. Among these materials, hydrophobized metal oxides such as silica and titanium oxide are preferable. When a hydrophobized silica and a hydrophobized titanium oxide are used in combination and the amount of the hydrophobized titanium oxide is greater than that of the hydrophobized silica, the toner has excellent charge stability regardless of humidity.

The image forming method according to exemplary aspects of the invention includes: forming an electrostatic latent image on an electrostatic latent image bearing member; developing the electrostatic latent image into a toner image by a developer; transferring the toner image from the electrostatic latent image bearing member onto a recording medium; and fixing the toner image on the recording medium.

Figure 2:
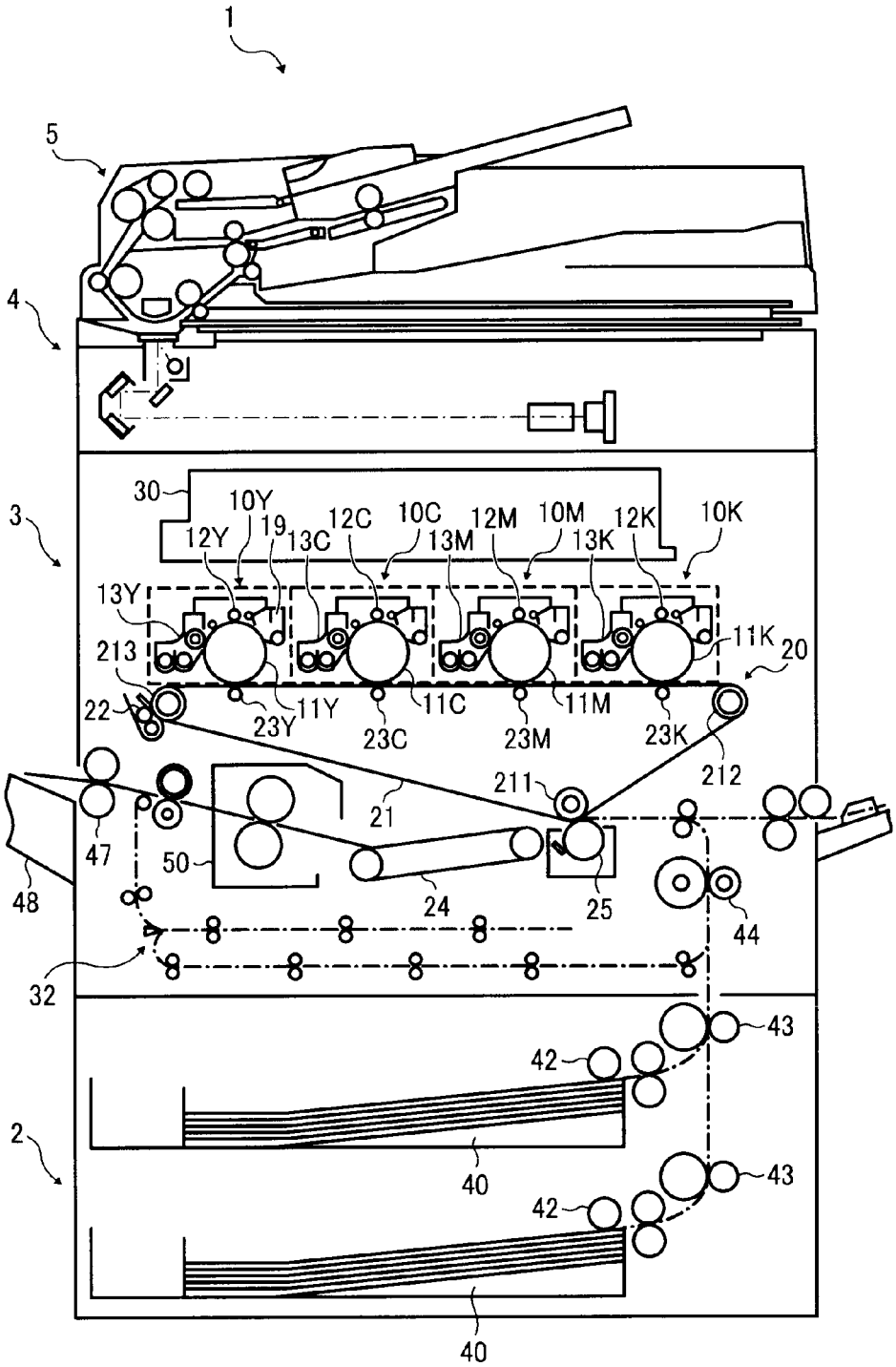
FIG. 2 is a schematic view illustrating an image forming apparatus according to exemplary embodiments of the invention.

FIG. 2 is a schematic view illustrating an image forming apparatus according to exemplary embodiments of the invention. An image forming apparatus 1 illustrated in FIG. 2 is a tandem image forming apparatus including four image forming stations. Each stations form images of different colors so that a full-color image is finally produced.

The image forming apparatus 1 includes an automatic document feeder (ADF) 5, a scanner 4 that reads documents and outputs a digital signal, an image processing part that electrically processes the digital signal, not shown, and an image forming part 3 that forms an image on a recording medium based on the digital signal output from the image processing part. In the scanner 4, a CCD camera reads a document put on a document table through an emission lamp, a mirror, and a lens. Image information read by the scanner 4 is sent to the image processing part. The image processing part converts the image information into an image signal to be sent to the image forming part 3.

In the image forming part 3, image forming stations 10Y, 10C, 10M, and 10K containing respective toners of yellow, cyan, magenta, and black are tandemly provided, and an intermediate transfer belt 21 and a secondary transfer roller 25 are further provided. The image forming stations 10Y, 10C, 10M, and 10K have the same configuration. Thus, FIG. 2 shows detailed configuration of the image forming station 10Y only. The additional characters Y, C, M, and K representing toner colors of yellow, cyan, magenta, and black, respectively, are hereinafter added or omitted as appropriate.

Each of the image forming stations 10 may be used as a process cartridge that is detachable from the image forming apparatus 1.

In an image forming operation, first, a photoreceptor 11Y serving as an electrostatic latent image bearing member is uniformly charged by a charger 12Y in the yellow the image forming station 10Y. Each of the photoreceptors 11Y, 11C, 11M, and 11K is electrically grounded and has an organic photosensitive layer on a core metal. The photoreceptors 11Y, 11C, 11M, and 11K are uniformly and negatively charged by respective chargers 12Y, 12C, 12M, and 12K and exposed to light beams emitted from an irradiator 30 having an laser diode. Thus, electrostatic latent images are formed on the photoreceptors 11Y, 11C, 11M, and 11K.

The charged photoreceptor 11Y is exposed to a light beam emitted from the irradiator 30 so that an electrostatic latent image of yellow components of an original full-color document is formed thereon. The electrostatic latent image is developed into a yellow image with a yellow toner contained in a yellow developing device 13Y. Similarly, toner images of cyan, magenta, and black are sequentially formed on the respective photoreceptors 11C, 11M, and 11K at a predetermined interval. The toner images of yellow, cyan, magenta, and black formed on the respective photoreceptors 11Y, 11C, 11M, and 11K are sequentially transferred onto the intermediate transfer belt 21 by applying a transfer bias to respective primary transfer rollers 23Y, 23C, 23M, and 23K provided facing the respective photoreceptors 11Y, 11C, 11M, and 11K. Thus, the toner images of yellow, cyan, magenta, and black are superimposed on one another on the intermediate transfer belt 21 and formed into a composite full-color toner image.

After the toner images have been transferred onto the intermediate transfer belt 21, surface potentials of the photoreceptors 11 are neutralized with optical neutralizers, not shown, and residual toner particles remaining on the photoreceptors 11 are removed by respective cleaners 19. Thus, the photoreceptors 11 become ready for a next image forming operation. The residual toner particles removed by the cleaners 19 are fed to a waste toner container via a waster toner feed path.

After the full-color toner image has been transferred onto a recording medium, residual toner particles and paper powders remaining on the intermediate transfer belt 21 are removed by a cleaning brush roller or a cleaning blade, not shown, and fed to the waste toner container. The intermediate transfer belt 21 is stretched across tension rollers 211, 212, and 213. The tension is controlled by a cam mechanism so that the position of the intermediate transfer belt 21 is variable between contact with and separation from the photoreceptors 11.

Thus, the intermediate transfer belt 21 is in contact state with the photoreceptors 11 during the occurrence of image forming operation and in separation state from the photoreceptors 11 during the absence of image forming operation.

After the toner images have been transferred onto the intermediate transfer belt 21, surface potentials of the photoreceptors 11 are neutralized with optical neutralizers. Thereafter, a brush roller provided to an upstream position in the cleaner 19 rotates so as to face in the direction of rotation of the photoreceptor 11 while contacting the photoreceptor 11, so that residual toner particles or adhered substances are disturbed and their adhesive force to the photoreceptor 11 is weakened. An elastic blade provided to a downstream position in the cleaner 19 is then brought into contact with the photoreceptor 11 so that the disturbed toner particles and substances are removed.

The composite full-color toner image is transferred onto a recording medium by the secondary transfer roller 25 to which a predetermined bias is applied. The recording medium is fed to a gap between the intermediate transfer belt 21 and the secondary transfer roller 25 in synchronization with an entry of the composite full-color toner image into the gap. A transfer device 20 includes the primary transfer rollers 23, the secondary transfer roller 25, the intermediate transfer belt 21, and a belt cleaner 22.

Multiple sheets of the recording medium are stored in multiple paper feed cassettes 40 of a paper feeder 2. The image forming apparatus 1 controls pickup rollers 42 to draw each sheet of the recording medium from the paper feed cassettes 40. The sheet is fed to the image forming part 3 by feed rollers 43. Registration roller 44 feeds the sheet toward the secondary transfer roller 25 in synchronization with an entry of the toner image on the intermediate transfer belt 21 into the gap between the secondary transfer roller 25.

The sheet of the recoding medium having the composite full-color toner image thereon is then fed to a fixing device 50, and the composite full-color toner image is fixed on the sheet by application of heat and pressure.

When printing images on both sides of the sheet, the sheet is refed to a double-side printing feed path 32 before fed to an ejection tray 48. Thereafter, the sheet is refed to the registration roller 44 so that an image is formed on another side of the sheet.

The developing device 13 includes a developing sleeve provided facing the photoreceptor 11. The developing sleeve internally contains a magnetic field generator. The charger 12 includes a charging roller provided facing the photoreceptor 11. The charging roller is applied with a predetermined voltage from a power source so as to uniformly charge a surface of the photoreceptor 11 while contacting or non-contacting the photoreceptor 11.

The cleaner 19 includes a cleaning blade that cleans the photoreceptor 11. The cleaner 19 further includes collection paddles that collect toner particles, a film, and a collection coil that transports the collected toner particles. The cleaning blade may be made of a metal, a resin, or a rubber, for example. In particular, fluorine rubbers, silicone rubbers, butyl rubbers, butadiene rubbers, isoprene rubber, and urethane rubbers are preferable, and urethane rubbers are most preferable. Additionally, a lubricant applicator that applies a lubricant to the photoreceptor 11 may be provided. The lubricant may be, for example, a resin (e.g., fluorine resin, silicone resin) or metal stearates (e.g., zinc stearate, aluminum stearate). In FIG. 2, a numeral 24 denotes a conveyance belt and a numeral 47 denotes an ejection roller.

Each of the image forming stations 10 may be used as a process cartridge that is detachable from the image forming apparatus 1.

Figure 3:
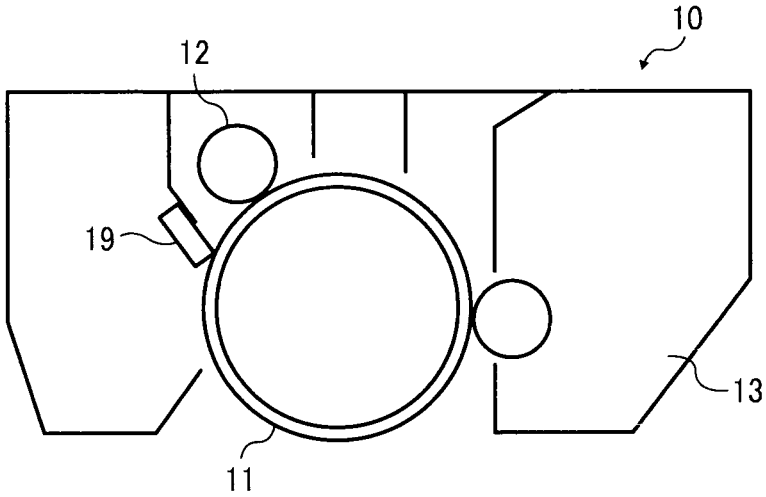
FIG. 3 is a schematic view illustrating a process cartridge according to exemplary embodiments of the invention.

FIG. 3 is a schematic view illustrating a process cartridge according to exemplary embodiments of the invention. The process cartridge 10 includes a photoreceptor 11, a charger 12, a developing device 13, and a cleaner 19. The process cartridge 10 at least includes the photoreceptor 11 and another member. An electrostatic latent image is formed on the photoreceptor 11 by emitting a laser light beam from an irradiator, not shown, thereto. The process cartridge 10 is detachably attachable to image forming apparatuses such as copiers and printers.

The carrier may be used for a supplemental developer that is supplied to a developing device while a deteriorated developer is discharged therefrom. Because deteriorated carrier particles are replaced with fresh carrier particles included in the supplemental developer, toner particles are reliably charged and images are stably produced for an extended period of time. The use of supplemental developer is effective when printing an image having a high area occupancy. When printing an image having a high area occupancy, carrier particles are deteriorated by adherence of toner particles while a large amount of supplemental carrier particles are supplied. Thus, the frequency of replacing deteriorated carrier particles with fresh carrier particles is increased and images are stably produced for an extended period of time.

The supplemental developer preferably includes a toner in an amount of 2 to 50 parts by weight, more preferably 5 to 12 parts by weight, based on 1 part by weight of the carrier. When the amount of toner is too small, toner particles may be excessively charged because an excessive amount of the carrier particles exist in a developing device. Because the excessively charged toner particles have poor developing power, the resulting image density may deteriorate. When the amount of toner is too large, the frequency of replacing deteriorated carrier particles with fresh carrier particles is reduced.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Copolymers

In the following descriptions, weight average molecular weights were measured by a gel permeation chromatography and converted using standard polystyrenes. Viscosities were measured by a method according to JIS-K2283 at 25° C. Nonvolatile contents were calculated from the following equation:

$$\text{Nonvolatile content}(\%)=(W(2)-W(1))\times 100/W(2)$$

wherein W(1) represents a weight of a sample which has been heated for 1 hour at 150° C. in an aluminum pan and W(2) represents a weight of the sample which has not been heated, i.e., 1 g.

Resin Manufacturing Example 1

A flask equipped with a stirrer was charged with 300 g of toluene and heated to 90° C. under nitrogen gas flow. A mixture of 84.4 g (i.e., 200 mmol) of 3-methacryloxypropyl tris(trimethylsiloxy)silane represented by $CH_2{=}CMe{-}COO{-}C_3H_6{-}Si(OSiMe_3)_3$ (Me: methyl group) (SILAPLANE TM-0701T from Chisso Corporation), 39 g (i.e., 150 mmol) of 3-methacryloxypropyl methyldiethoxysilane, 65.0 g (i.e., 650 mmol) of methyl methacrylate, and 0.58 g (i.e., 3 mmol) of 2,2'-azobis-2-methylbutylonitrile was dropped in the flask over a period of 1 hour.

Further, a solution of 6 g (i.e., 0.3 mmol) of 2,2-azobis-2-methylbutylonitrole dissolved in 15 g of toluene was added to the flask. (The total amount of 2,2-azobis-2-methylbutylonitrole was 0.64 g, i.e., 3.3 mmol.) The mixture was then agitated for 3 hours at 90 to 100° C. to be subjected to radical polymerization. Thus, a resin 1 that is a methacrylic copolymer was prepared.

The resin 1 had a weight average molecular weight of 33,000. The resin 1 was diluted with toluene so that the diluted solution had 25% by weight of nonvolatile contents. The diluted toluene solution of the resin 1 had a viscosity of 8.8 $mm^2/s$ and a specific weight of 0.91.

Resin Manufacturing Example 2

The procedure for preparing the resin 1 was repeated except for replacing the 39 g (i.e., 150 mmol) of 3-methacryloxypropyl methyldiethoxysilane with 37.2 g (i.e., 150 mmol) of 3-methacryloxypropyl trimethoxysilane. Thus, a resin 2 that is a methacrylic copolymer was prepared.

The resin 2 had a weight average molecular weight of 34,000. The resin 2 was diluted with toluene so that the diluted solution had 25% by weight of nonvolatile contents. The diluted toluene solution of the resin 2 had a viscosity of 8.7 $mm^2/s$ and a specific weight of 0.91.

Resin Manufacturing Example 3

A flask equipped with a stirrer was charged with 500 g of toluene and heated to 90° C. under nitrogen gas flow. A mixture of 126.6 g (i.e., 300 mmol) of 3-methacryloxypropyl tris(trimethylsiloxy)silane represented by $CH_2{=}CMe{-}COO{-}C_3H_6{-}Si(OSiMe_3)_3$ (Me: methyl group) (SILAPLANE TM-0701T from Chisso Corporation), 173.6 g (i.e., 700 mmol) of 3-methacryloxypropyl trimethoxysilane, and 0.58 g (i.e., 3 mmol) of 2,2'-azobis-2-methylbutylonitrile was dropped in the flask over a period of 1 hour.

Further, a solution of 6 g (i.e., 0.3 mmol) of 2,2-azobis-2-methylbutylonitrole dissolved in 15 g of toluene was added to the flask. (The total amount of 2,2-azobis-2-methylbutylonitrole was 0.64 g, i.e., 3.3 mmol.) The mixture was then agitated for 3 hours at 90 to 100° C. to be subjected to radical polymerization. Thus, a resin 3 that is a methacrylic copolymer was prepared.

The resin 3 had a weight average molecular weight of 35,000. The resin 3 was diluted with toluene so that the diluted solution had 25% by weight of nonvolatile contents. The diluted toluene solution of the resin 3 had a viscosity of 8.5 $mm^2/s$ and a specific weight of 0.91.

Resin Manufacturing Example 4

A 500-ml flask equipped with a stirrer, a condenser, a thermometer, a nitrogen inlet pipe, and a dropping device was charged with 100 parts of MEK (methyl ethyl ketone). A solution in which 32.6 parts of MMA (methyl methacrylate), 2.5 parts of HEMA (2-hydroxyethyl methacrylate), 64.9 parts of MPTS (organopolysiloxane:methacryloxypropyl tris(trimethylsiloxy)silane=1:3), and 1 part of 1,1'-azobis(cyclohexane-1-carbonitrile) (V-40 from Wako Pure Chemical Industries, Ltd.) were dissolved in 100 parts of MEK was dropped in the flask over a period of 2 hours at 80° C. under nitrogen gas flow. The mixture was subjected to aging for 5 hours. Thus, a resin 4 was prepared.

The resin 4 was diluted with MEK so that the diluted solution had 25% by weight of nonvolatile contents.

Resin Manufacturing Example 5

The procedure for preparing the resin 1 was repeated except that the amounts of the 3-methacryloxypropyl tris (trimethylsiloxy)silane (SILAPLANE TM-0701T from Chisso Corporation) and 3-methacryloxypropyl trimethoxysilane were changed to 379.8 g (i.e., 900 mmol) and 24.8 g (i.e., 100 mmol), respectively. Thus, a resin 5 that is a methacrylic copolymer was prepared. The resin 5 had a weight average molecular weight of 37,000. The resin 5 was diluted with toluene so that the diluted solution had 25% by weight of nonvolatile contents. The diluted toluene solution of the resin 5 had a viscosity of 8.4 $mm^2/s$ and a specific weight of 0.92.

Resin Manufacturing Example 6

The procedure for preparing the resin 1 was repeated except that the amounts of the 3-methacryloxypropyl tris (trimethylsiloxy)silane (SILAPLANE TM-0701T from Chisso Corporation) and 3-methacryloxypropyl trimethoxysilane were changed to 42.2 g (i.e., 100 mmol) and 223.2 g (i.e., 900 mmol), respectively. Thus, a resin 6 that is a methacrylic copolymer was prepared. The resin 6 had a weight average molecular weight of 34,000. The resin 6 was diluted with toluene so that the diluted solution had 25% by weight of nonvolatile contents. The diluted toluene solution of the resin 6 had a viscosity of 8.7 $mm^2/s$ and a specific weight of 0.90.

Resin Manufacturing Example 7

A flask equipped with a stirrer was charged with 300 g of toluene and heated to 90° C. under nitrogen gas flow. A mixture of 168.8 g (i.e., 400 mmol) of 3-methacryloxypropyl tris(trimethylsiloxy)silane represented by $CH_2{=}CMe{-}COO{-}C_3H_6{-}Si(OSiMe_3)_3$ (Me: methyl group) (SILAPLANE TM-0701T from Chisso Corporation), 78 g (i.e., 300 mmol) of 3-methacryloxypropyl methyldiethoxysilane, 30.0 g (i.e., 300 mmol) of methyl methacrylate, and 0.58 g (i.e., 3 mmol) of 2,2'-azobis-2-methylbutylonitrile was dropped in the flask over a period of 1 hour.

Further, a solution of 6 g (i.e., 0.3 mmol) of 2,2-azobis-2-methylbutylonitrole dissolved in 15 g of toluene was added to the flask. (The total amount of 2,2-azobis-2-methylbutylonitrole was 0.64 g, i.e., 3.3 mmol.) The mixture was then agitated for 3 hours at 90 to 100° C. to be subjected to radical polymerization. Thus, a resin 7 that is a methacrylic copolymer was prepared.

The resin 7 had a weight average molecular weight of 36,000. The resin 7 was diluted with toluene so that the diluted solution had 25% by weight of nonvolatile contents. The diluted toluene solution of the resin 7 had a viscosity of 8.7 $mm^2/s$ and a specific weight of 0.90.

Preparation of Carriers

Carrier Manufacturing Example 1

A resin solution was prepared by diluting 100 parts of the resin 1, 147 parts of a conductive particle (i.e., EC-500 from Titan Kogyo, Ltd. that is a conductive inorganic oxide having a particle diameter of 0.43 μm), and 4 parts of a catalyst (i.e., TC-750 from Matsumoto Fine Chemical Co., Ltd. that is titanium diisopropoxybis(ethylacetoacetate) with toluene. The resin solution included 10% by weight of solid components.

The resin solution was coated on a core particle, i.e., Mn—Mg—Sr ferrite particles (including 23% of Fe, 12% of Mn, 1.5% of Mg, and 0.3% of Sr) having a weight average particle diameter of 35 μm using a fluidized-bed-type coating device at 70° C. so that the resulting resin layer had an average thickness of 0.3 μm. The core particles having the resin coating were burnt in an electric furnace at 180° C. for 1 hour. Thus, a carrier A was prepared.

Carrier Manufacturing Example 2

The procedure for preparing the carrier A in Carrier Manufacturing Example 1 was repeated except for replacing the resin 1 with the resin 2. Thus, a carrier B was prepared.

Carrier Manufacturing Example 3

The procedure for preparing the carrier A in Carrier Manufacturing Example 1 was repeated except for replacing the resin 1 with the resin 3. Thus, a carrier C was prepared.

Carrier Manufacturing Example 4

The procedure for preparing the carrier A in Carrier Manufacturing Example 1 was repeated except for replacing the Mn—Mg—Sr ferrite particles with other Mn—Mg—Sr ferrite particles (including 27% of Fe, 13% of Mn, 1.6% of Mg, and 0.08% of Sr) having a weight average particle diameter of 35 μm. Thus, a carrier D was prepared.

Carrier Manufacturing Example 5

The procedure for preparing the carrier A in Carrier Manufacturing Example 1 was repeated except for replacing the Mn—Mg—Sr ferrite particles with other Mn—Mg—Sr ferrite particles (including 25% of Fe, 12% of Mn, 1.4% of Mg, and 3.0% of Sr) having a weight average particle diameter of 35 μm. Thus, a carrier E was prepared.

Carrier Manufacturing Example 6

The procedure for preparing the carrier A in Carrier Manufacturing Example 1 was repeated except for replacing the Mn—Mg—Sr ferrite particles with other Mn—Mg—Sr ferrite particles (including 27% of Fe, 13% of Mn, 1.7% of Mg, and 0.005% of Sr) having a weight average particle diameter of 35 μm. Thus, a carrier F was prepared.

Carrier Manufacturing Example 7

The procedure for preparing the carrier A in Carrier Manufacturing Example 1 was repeated except for replacing the Mn—Mg—Sr ferrite particles with other Mn—Sr ferrite particles (including 33% of Fe, 5.4% of Mg, and 0.15% of Sr) having a weight average particle diameter of 35 μm. Thus, a carrier G was prepared.

Carrier Manufacturing Example 8

The procedure for preparing the carrier B in Carrier Manufacturing Example 2 was repeated except for replacing the Mn—Mg—Sr ferrite particles with other Mn—Mg—Sr ferrite particles (including 27% of Fe, 13% of Mn, 1.6% of Mg, and 0.08% of Sr) having a weight average particle diameter of 35 μm. Thus, a carrier H was prepared.

Carrier Manufacturing Example 9

The procedure for preparing the carrier B in Carrier Manufacturing Example 2 was repeated except for replacing the Mn—Mg—Sr ferrite particles with other Mn—Mg—Sr ferrite particles (including 25% of Fe, 12% of Mn, 1.4% of Mg, and 3.0% of Sr) having a weight average particle diameter of 35 μm. Thus, a carrier I was prepared.

Carrier Manufacturing Example 10

The procedure for preparing the carrier B in Carrier Manufacturing Example 2 was repeated except for replacing the Mn—Mg—Sr ferrite particles with other Mn—Mg—Sr ferrite particles (including 27% of Fe, 13% of Mn, 1.7% of Mg, and 0.005% of Sr) having a weight average particle diameter of 35 μm. Thus, a carrier J was prepared.

Carrier Manufacturing Example 11

The procedure for preparing the carrier C in Carrier Manufacturing Example 3 was repeated except for replacing the Mn—Mg—Sr ferrite particles with other Mn—Mg—Sr ferrite particles (including 27% of Fe, 13% of Mn, 1.6% of Mg, and 0.08% of Sr) having a weight average particle diameter of 35 μm. Thus, a carrier K was prepared.

Carrier Manufacturing Example 12

The procedure for preparing the carrier C in Carrier Manufacturing Example 3 was repeated except for replacing the Mn—Mg—Sr ferrite particles with other Mn—Mg—Sr ferrite particles (including 25% of Fe, 12% of Mn, 1.4% of Mg, and 3.0% of Sr) having a weight average particle diameter of 35 μm. Thus, a carrier L was prepared.

Carrier Manufacturing Example 13

The procedure for preparing the carrier C in Carrier Manufacturing Example 3 was repeated except for replacing the Mn—Mg—Sr ferrite particles with other Mn—Mg—Sr ferrite particles (including 27% of Fe, 13% of Mn, 1.7% of Mg, and 0.005% of Sr) having a weight average particle diameter of 35 μm. Thus, a carrier M was prepared.

Carrier Manufacturing Example 14

The procedure for preparing the carrier A in Carrier Manufacturing Example 1 was repeated except for replacing the resin 1 with the resin 5. Thus, a carrier N was prepared.

Carrier Manufacturing Example 15

The procedure for preparing the carrier A in Carrier Manufacturing Example 1 was repeated except for replacing the resin 1 with the resin 6. Thus, a carrier O was prepared.

Carrier Manufacturing Example 16

The procedure for preparing the carrier A in Carrier Manufacturing Example 1 was repeated except for replacing the resin 1 with the resin 7. Thus, a carrier P was prepared.

Carrier Manufacturing Comparative Example 1

The procedure for preparing the carrier A in Carrier Manufacturing Example 1 was repeated except for replacing the resin 1 with the resin 4. Thus, a carrier Q was prepared.

Carrier Manufacturing Comparative Example 2

The diluted solution of the resin 4 prepared in Resin Manufacturing Example 4 was mixed with a cross-linking agent, i.e., isophorone diisocyanate (IPDI)/trimethylolpropane adduct (TMI) (having 6.1% of NCO), so that the molar ratio (OH/NCO) of hydroxyl groups in the resin 4 to NCO groups in the cross-linking agent became 1/1, and further diluted with MEK. Thus, a resin solution including 3% by weight of solid components was prepared.

The resin solution was coated on a core particle, i.e., Mn—Mg—Sr ferrite particles (including 23% of Fe, 12% of Mn, 1.5% of Mg, and 0.3% of Sr) having a weight average particle diameter of 35 μm using a fluidized-bed-type coating device at 70° C. so that the resulting resin layer had an average thickness of 0.30 μm.

The core particles having the resin coating were burnt in an electric furnace at 180° C. for 1 hour. Thus, a carrier R was prepared.

Carrier Manufacturing Comparative Example 3

The procedure for preparing the carrier A in Carrier Manufacturing Example 1 was repeated except that the resin 1 was replaced with 30 parts of a methyl silicone resin (having 25% of solid components) having a weight average molecular weight of 15,000 obtained from difunctional or trifunctional monomers. Thus, a carrier S was prepared.

Carrier Manufacturing Comparative Example 4

The procedure for preparing the carrier A in Carrier Manufacturing Example 1 was repeated except for replacing the Mn—Mg—Sr ferrite particles with Mn—Mg ferrite particles (including 28% of Fe, 14% of Mn, and 1.7% of Mg) having a weight average particle diameter of 35 μm. Thus, a carrier T was prepared.

Carrier Manufacturing Comparative Example 5

The procedure for preparing the carrier A in Carrier Manufacturing Example 1 was repeated except for replacing the Mn—Mg—Sr ferrite particles with other Mn—Mg—Sr ferrite particles (including 24% of Fe, 12% of Mn, 1.3% of Mg, and 1.3% of Sr) having a weight average particle diameter of 35 μm. Thus, a carrier U was prepared.

Evaluations of Carriers

The above-prepared carriers were subjected to the following evaluations.

Weight Average Particle Diameter of Core Particle

The weight average particle diameter of each of the core particles was measured by a Microtrac particle size analyzer HRA9320-X100 (from Nikkiso Co., Ltd.).

Magnetization in 1 kOe Magnetic Field

A measuring cell having an inner diameter of 2.4 mm and a height of 8.5 mm was filled with about 0.15 g of each of the carriers, and subjected to measurement of magnetization in a magnetic field of 1 kOe using an instrument VSM-P7-15 (from Toei Industry Co., Ltd.).

Volume Resistivity

The volume resistivity was measured using a measuring cell illustrated in FIG. 1 as follows. The measuring cell was comprised of a fluorocarbon-resin container 102, in which electrodes 101*a* and 101*b* each having a surface area of 2.5 cm×4 cm are facing at a distance of 0.2 cm. The measuring cell was filled with the carrier 103 and tapped from a height of 1 cm for 10 times at a tapping speed of 30 times/min. Thereafter, a direct current voltage of 1,000 V was applied to between the electrodes 101*a* and 101*b* for 30 seconds to measure a resistance r (Ω) by a high resistance meter 4329A (from Hewlett-Packard Japan. Ltd.). A volume resistivity (Ω·cm) was calculated from the following equation:

$$\text{Volume Resistivity}(\Omega\cdot\text{cm})=r\times(2.5\times4)/0.2$$

Average Thickness of Resin Layer

The average thickness of the resin layers were measured by observing cross-sections of the carriers using a transmission electron microscope (TEM).

The evaluation results are shown in Table 1.

TABLE 1

| Resin No. | Carrier Manufacturing Example No. | Carrier Name | Weight Average Particle Diameter (μm) | Magnetization (emu/g) | Volume Resistivity (LogR(Ω · m)) | Thickness of Resin Layer (μm) |
|---|---|---|---|---|---|---|
| 1 | 1 | A | 35.8 | 64 | 13.7 | 0.30 |
| 2 | 2 | B | 35.9 | 64 | 13.8 | 0.29 |
| 3 | 3 | C | 36.1 | 64 | 13.8 | 0.30 |
| 1 | 4 | D | 36.0 | 63 | 13.8 | 0.31 |
| 1 | 5 | E | 35.8 | 65 | 13.6 | 0.30 |
| 1 | 6 | F | 35.9 | 63 | 13.7 | 0.30 |
| 1 | 7 | G | 36.0 | 62 | 13.9 | 0.28 |
| 2 | 8 | H | 36.0 | 63 | 13.8 | 0.30 |
| 2 | 9 | I | 35.8 | 65 | 13.7 | 0.30 |
| 2 | 10 | J | 35.9 | 63 | 13.8 | 0.29 |
| 3 | 11 | K | 36.1 | 64 | 13.8 | 0.31 |
| 3 | 12 | L | 35.9 | 65 | 13.7 | 0.29 |
| 3 | 13 | M | 36.0 | 63 | 13.8 | 0.31 |
| 4 | 14 | N | 36.0 | 64 | 13.6 | 0.29 |
| 5 | 15 | O | 35.9 | 64 | 13.8 | 0.30 |
| 6 | 16 | P | 35.9 | 63 | 13.8 | 0.30 |
| 4 | Comparative 1 | Q | 36.2 | 64 | 13.8 | 0.31 |
| 4 | Comparative 2 | R | 36.0 | 64 | 13.8 | 0.29 |
| — | Comparative 3 | S | 36.2 | 64 | 13.9 | 0.28 |
| 1 | Comparative 4 | T | 35.9 | 63 | 13.9 | 0.30 |
| 1 | Comparative 5 | U | 36.1 | 64 | 13.7 | 0.31 |

Preparation of Toner

Preparation of Polyester Resin A

A reaction vessel equipped with a thermometer, a stirrer, a condenser, and a nitrogen inlet pipe was charged with 443 parts of a PO adduct of bisphenol A (having a hydroxyl value of 320), 135 parts of diethylene glycol, 422 parts of terephthalic acid, and 2.5 parts of dibutyltin oxide. The mixture was subjected to reaction at 200° C. until the acid value became 10. Thus, a polyester resin A was prepared. The polyester resin A had a glass transition temperature of 63° C. and a peak number average molecular weight of 6,000.

Preparation of Polyester Resin B

A reaction vessel equipped with a thermometer, a stirrer, a condenser, and a nitrogen inlet pipe was charged with 443 parts of a PO adduct of bisphenol a (having a hydroxyl value of 320), 135 parts of diethylene glycol, 422 parts of terephthalic acid, and 2.5 parts of dibutyltin oxide. The mixture was subjected to reaction at 230° C. until the acid value became 7. Thus, a polyester resin B was prepared. The polyester resin B had a glass transition temperature of 65° C. and a peak number average molecular weight of 16,000.

Preparation of Mother Toner

First, 40 parts of the polyester resin A, 60 parts of the polyester resin B, 1 part of a carnauba wax, and 10 parts of a carbon black (#44 from Mitsubishi Chemical Corporation) were mixed for 3 minutes at 1,500 rpm by a HENSCHEL MIXER 20B (from Nippon Coke & Engineering Co., Ltd.). The mixture was kneaded by a single-axis kneader KONEADER (from Buss Corporation) while setting the inlet temperature to 100° C., the outlet temperature to 50° C., and the feed rate to 2 kg/hr. Thus, a mother toner A1 was prepared.

The mother toner A1 was then rolled and cooled, and pulverized into coarse particles by a pulverizer. The coarse particles were further pulverized into fine particles by an I-type mill (IDS-2 from Nippon Pneumatic Mfg. Co., Ltd.) using a flat collision plate while setting the air pressure to 6.8 atm/cm$^2$ and the feed rate to 0.5 kg/hr. The fine particles were classified by a classifier (132MP from Alpine). Thus, a mother toner 1 was prepared.

The mother toner 1 in an amount of 100 parts was mixed with 1.0 part of a hydrophobized silica particle (R972 from Nippon Aerosil Co., Ltd.) by a HENSCHEL MIXER. Thus, a toner 1 was prepared.

Preparation of Developers

Each of the carriers A to U in an amount of 93 parts and the toner 1 (having an average particle diameter of 7.2 μm) in an amount of 7 parts were mixed for 20 minutes using a ball mill. Thus, developers A to U were prepared.

Evaluations of Developers

In the following evaluations, a digital full-color multifunctional image forming apparatus IMAGIO NEO C600 (from Ricoh Co., Ltd.) was used.

Change in Volume Resistivity

Each of the developers A to U and the toner 1 were set in IMAGIO NEO C600, and a running test in which an image having an area occupancy of 0.5% was continuously produced was performed. The initial volume resistivity (R1) of the carrier before the running test, the volume resistivity (R2) of the carrier after the 100,000 image was printed, and the volume resistivity (R3) of the carrier after the 300,000 image was printed were measured to determine change in volume resistivity.

The initial volume resistivity (R1) was determined by measuring volume resistivity of each of the carriers A to U. The volume resistivity (R2) of the carrier after the 100,000 image was printed and the volume resistivity (R3) of the carrier after the 300,000 image was printed were determined by measuring volume resistivity of the developer from which toner particles were removed using a blow off device. A desired value of common logarithm of the volume resistivity LogR1, LogR2, or LogR3 is 1.5 (Log(Ω·cm)) or less.

Magnet Brush Mark on Image

After the 300,000 image was printed in the above-described running test, a solid image having an image density of about 1.5 was produced by controlling the potential conditions. The solid image was visually observed to determine whether or not the magnetic brush left mark thereon. The results were graded into the following 3 levels. A and B are acceptable.

A: No mark was observed.

B: A mark was slightly observed.

C: A mark was clearly observed.

Carrier Deposition

Before the above-described running test and after the 100,000 and 300,000 images were printed in the above-described running test, the charged potential DC was set to 740 V and the developing bias was set to 600 V while keeping the background potential to 100 V to form a halftone image on the photoreceptor. Randomly selected 5 portions on the surface of the photoreceptor were visually observed with a loupe to count the number of carrier particles deposited thereon, and the number of carrier particles deposited per 100 $cm^2$ was calculated. The results were graded into the following 4 levels. A+, A, and B are acceptable.

A+: 5 or less

A: 6 to 20

B: 21 to 50

C: 51 or more

Change in Charge Quantity

In the following evaluation, a digital full-color multifunctional image forming apparatus IMAGIO NEO C600 (from Ricoh Co., Ltd.) was used. Each of the developers A to U and the toner 1 were set in IMAGIO NEO C600, and a running test in which an image having an area occupancy of 20% was continuously produced was performed. The initial charge quantity (Q1) of the carrier before the running test and the charge quantity (Q2) of the carrier after the 100,000 image was printed were measured to determine change in charge quantity.

The initial charge quantity (Q1) was measured by mixing 93 parts of each of the carriers A to U and 7 parts of the toner 1 so that the toner 1 was frictionally charged and subjecting the mixture to a measurement using a blow off device (TB-200 from Toshiba Chemical Corporation). The charge quantity (Q2) of the carrier after the 100,000 image was printed was determined by measuring charge quantity of the developer from which toner particles were removed using a blow off device. A desired value of the charge quantity is 10 μC/g or less.

The evaluation results are shown in Tables 2 and 3.

TABLE 2

| Carrier Manufacturing Example No. | Carrier Name | Developer Name | Change in Volume Resistivity LogR1 (Ω · m) | LogR2 (Ω · m) | LogR1 − LogR2 (Ω · m) | LogR3 (Ω · m) | LogR1 − LogR3 (Ω · m) | Magnetic Brush Mark |
|---|---|---|---|---|---|---|---|---|
| 1 | A | A | 13.7 | 13.8 | −0.1 | 13.5 | 0.2 | A |
| 2 | B | B | 13.8 | 13.8 | 0.0 | 13.2 | 0.6 | A |
| 3 | C | C | 13.8 | 13.3 | 0.5 | 13.0 | 0.8 | A |
| 4 | D | D | 13.8 | 13.9 | −0.1 | 13.3 | 0.5 | A |
| 5 | E | E | 13.6 | 13.5 | 0.1 | 13.3 | 0.3 | B |
| 6 | F | F | 13.7 | 13.7 | 0.0 | 13.6 | 0.1 | A |
| 7 | G | G | 13.9 | 13.6 | 0.3 | 13.4 | 0.5 | A |
| 8 | H | H | 13.8 | 13.7 | 0.1 | 13.1 | 0.7 | A |
| 9 | I | I | 13.7 | 13.7 | 0.0 | 13.0 | 0.7 | B |
| 10 | J | J | 13.8 | 13.6 | 0.2 | 13.3 | 0.5 | A |
| 11 | K | K | 13.8 | 13.1 | 0.7 | 12.8 | 1.0 | A |
| 12 | L | L | 13.7 | 13.4 | 0.3 | 12.9 | 0.8 | B |
| 13 | M | M | 13.8 | 13.3 | 0.5 | 13.0 | 0.8 | A |
| 14 | N | N | 13.6 | 12.7 | 0.9 | 12.2 | 1.4 | A |
| 15 | O | O | 13.8 | 13.0 | 0.8 | 12.5 | 1.3 | A |
| 16 | P | P | 13.8 | 13.5 | 0.3 | 13.1 | 0.7 | A |
| Comparative 1 | Q | Q | 13.8 | 13.0 | 0.8 | 12.1 | 1.7 | A |
| Comparative 2 | R | R | 13.8 | 14.7 | −0.9 | 14.6 | −0.8 | A |
| Comparative 3 | S | S | 13.9 | 13.5 | 0.4 | 12.3 | 1.6 | A |
| Comparative 4 | T | T | 13.9 | 13.8 | 0.1 | 13.5 | 0.4 | A |
| Comparative 5 | U | U | 13.7 | 13.7 | 0.0 | 13.4 | 0.3 | C |

TABLE 3

| Carrier Manufacturing Example No. | Carrier Name | Developer Name | Carrier Deposition Initial | After 10K$^{th}$ image | After 30K$^{th}$ image | Change in Charge Quantity Q1 (−μC/g) | Q2 (−μC/g) | Q1 − Q2 (−μC/g) |
|---|---|---|---|---|---|---|---|---|
| 1 | A | A | A+ | A+ | A | 37 | 36 | 1 |
| 2 | B | B | A+ | A | A | 38 | 34 | 4 |
| 3 | C | C | A+ | A+ | A | 40 | 36 | 4 |
| 4 | D | D | A | A | B | 36 | 34 | 2 |
| 5 | E | E | A+ | A+ | A | 38 | 37 | 1 |
| 6 | F | F | A | B | B | 38 | 36 | 2 |
| 7 | G | G | A+ | A | A | 37 | 37 | 0 |
| 8 | H | H | A | A | B | 38 | 35 | 3 |
| 9 | I | I | A+ | A+ | A | 38 | 33 | 5 |
| 10 | J | J | A | A | B | 39 | 35 | 4 |
| 11 | K | K | A+ | A | A | 41 | 36 | 5 |
| 12 | L | L | A+ | A+ | A | 40 | 34 | 6 |
| 13 | M | M | A | B | B | 39 | 35 | 4 |
| 14 | N | N | A+ | A+ | A | 36 | 31 | 5 |
| 15 | O | O | A+ | A+ | A | 40 | 31 | 9 |
| 16 | P | P | A+ | A+ | A | 37 | 32 | 5 |

TABLE 3-continued

| Carrier | | | Carrier Deposition | | | Change in Charge Quantity | | |
|---|---|---|---|---|---|---|---|---|
| Manufacturing Example No. | Carrier Name | Developer Name | Initial | After 10K$^{th}$ image | After 30K$^{th}$ image | Q1 (−μC/g) | Q2 (−μC/g) | Q1 − Q2 (−μC/g) |
| Comparative 1 | Q | Q | A+ | A | A | 46 | 28 | 18 |
| Comparative 2 | R | R | A+ | A+ | A | 38 | 19 | 19 |
| Comparative 3 | S | S | A+ | A | A | 33 | 38 | −5 |
| Comparative 4 | T | T | B | B | C | 35 | 36 | −1 |
| Comparative 5 | U | U | A+ | A+ | A | 39 | 36 | 3 |

Additional modifications and variations of the present invention are possible in light of the above teachings. It is therefore to be understood that within the scope of the appended claims the invention may be practiced other than as specifically described herein.

What is claimed is:

1. A carrier for developing electrostatic latent image, comprising:

a magnetic core particle being a ferrite particle including strontium in an amount of 0.005 to 3% by mass, the amount being measured by fluorescent X-ray spectroscopy; and a resin layer covering a surface of the magnetic core particle, the resin layer comprising a resin obtained by heating a copolymer comprising a unit A having the following formula (A) and a unit B having the following formula (B):

(A)

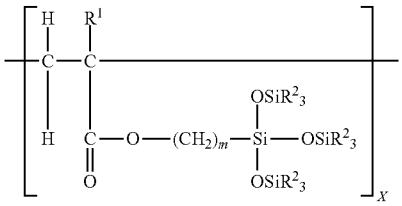

(B)

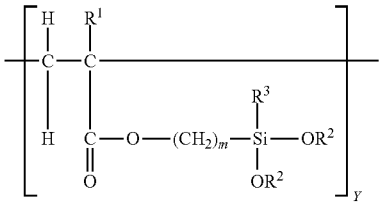

wherein $R^1$ represents a hydrogen atom or a methyl group, each of multiple $R^2$ independently represents an alkyl group having 1 to 4 carbon atoms, $R^3$ represents an alkyl group having 1 to 8 carbon atoms or an alkoxy group having 1 to 4 carbon atoms, m represents an integer of 1 to 8, X represents a molar ratio (%) between 10 to 90, and Y represents a molar ratio (%) between 90 to 10.

2. The carrier according to claim 1, the copolymer comprising a copolymer having the following formula (1):

(1)

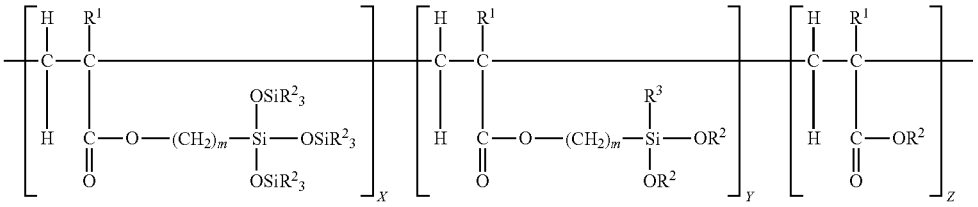

wherein each of multiple $R^1$ independently represents a hydrogen atom or a methyl group, each of multiple $R^2$ independently represents an alkyl group having 1 to 4 carbon atoms, $R^3$ represents an alkyl group having 1 to 8 carbon atoms or an alkoxy group having 1 to 4 carbon atoms, m represents an integer of 1 to 8, each of X represents a molar ratio (%) between 10 to 40, Y represents a molar ratio (%) between 10 to 40 , Z represents a molar ratio (%) between 30 to 80, and 60 <Y+Z <90 is satisfied.

3. The carrier according to claim 1, the resin layer further comprising a conductive particle, the conductive particle covering 10 to 80% of a surface of the core particle.

4. The carrier according to claim 1, obtained by a method comprising:

covering the surface of the core particle with the copolymer; and heating the copolymer to form the resin layer.

5. The carrier according to claim 4, the copolymer being heated to a temperature of 100 to 350° C.

6. The carrier according to claim 1, the carrier having a volume resistivity of $1\times10^9$ to $1\times10^{17}$ Ω·cm.

7. The carrier according to claim 1, the resin layer having an average thickness of 0.05 to 4 μm.

8. The carrier according to claim 1, the core particle having a weight average particle diameter of 20 to 65 μm.

9. The carrier according to claim 1, the carrier having a magnetization of 40 to 90 $Am^2/kg$ in a magnetic field of 1 kOe.

10. A developer, comprising a toner and the carrier according to claim 1.

11. The developer according to claim 10, the toner being a toner for forming a full-color image.

12. A method of manufacturing a carrier, comprising:

covering a surface of a magnetic core particle including strontium in an amount of 0.005 to 3% by mass, the amount being measured by fluorescent X-ray spectroscopy, with a copolymer comprising a unit A having the following formula (A) and a unit B having the following formula (B):

(A)

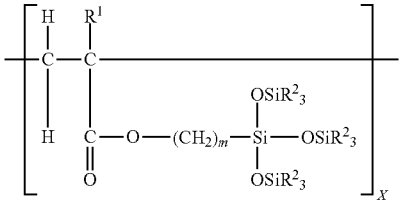

(B)

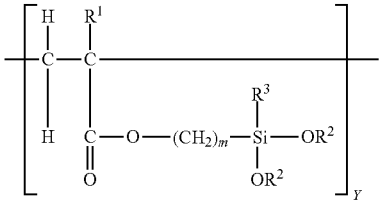

wherein R'represents a hydrogen atom or a methyl group, each of multiple $R^2$ independently represents an alkyl group having 1 to 4 carbon atoms, $R^3$ represents an alkyl group having 1 to 8 carbon atoms or an alkoxy group having 1 to 4 carbon atoms, m represents an integer of 1 to 8, X represents a molar ratio (%) between 10 to 90, and Y represents a molar ratio (%) between 90 to 10; and heating the copolymer to form a resin layer.

13. An image forming method, comprising:

forming an electrostatic latent image on an electrostatic latent image bearing member;

developing the electrostatic latent image into a toner image with the developer according to claim 10;

transferring the toner image from the electrostatic latent image bearing member onto a recording medium; and fixing the toner image on the recording medium.

14. A supplemental developer, comprising: The carrier according to claim 1 in an amount of 1 part by weight; and a toner in an amount of 2 to 50 parts by weight.

* * * * *